United States Patent [19]

Tsukioka

[11] Patent Number: 4,743,716

[45] Date of Patent: May 10, 1988

[54] PRESSURE SENSOR

[75] Inventor: Ichiro Tsukioka, Chiba, Japan

[73] Assignee: Kogyo Keiki Kabushiki Kaisha, Tokyo, Japan

[21] Appl. No.: 17,349

[22] Filed: Feb. 24, 1987

[30] Foreign Application Priority Data

Sep. 30, 1986 [JP] Japan ..... 61-149853[U]

[51] Int. Cl.[4] ..... H01H 35/34

[52] U.S. Cl. ..... 200/83 Y; 200/83 J; 73/745

[58] Field of Search ..... 91/1; 92/5 R; 73/717, 73/723, 745; 340/626; 200/81.5, 82 R, 82 C, 83 R, 83 J, 83 Y, 81.4

[56] References Cited

U.S. PATENT DOCUMENTS 4,081,636 3/1978 Rice ..... 200/834

4,267,413 5/1981 Reis ..... 200/834

4,413,526 11/1983 Delajoud ..... 73/745

*Primary Examiner*—G. P. Tolin

*Attorney, Agent, or Firm*—Price, Heneveld, Cooper, DeWitt & Litton

[57] ABSTRACT

A pressure sensor adapted for use in pressure switches, pressure detectors, pressure measuring instruments, etc. has a housing. The housing has at one end a force balance valve including a gas chamber sealed at one end by a valve diaphragm and filled with a pressurized gas, and at the other end a pressure receiving section sealed at one end by a pressure receiving diaphragm. The housing further has first and second cylinders with corresponding first and second pistons held in contact with the valve diaphragm and the pressure receiving diaphragm, respectively. Between the first and second pistons is provided a connecting member with an actuating section. The housing further has a working section which is actuated by the actuating section to provide an output or signal externally.

7 Claims, 2 Drawing Sheets

PRESSURE SENSOR

BACKGROUND OF THE INVENTION

1. Field of the Invention

This invention relates to a pressure sensor which is widely used in pressure switches, pressure detectors, pressure measuring instruments, etc.

2. Description of the Prior Art

Hitherto, various types of pressure sensors have been used. One conventional pressure switch incorporating therein an exemplary pressure sensor will first be described, which is configured as shown in FIG. 3.

In this drawings, reference symbol a designates a housing, b a pressure receiving section provided in the housing a, and c a fluid path. Symbol d designates a diaphragm made of stainless steel or rubber which is shaped in the form of a thin plate for easy deformation. Symbol e designates an O-ring, f a cylinder, and g a piston. A piston rod h of the piston g is connected with a switch i provided inside the housing a. Symbol j designates a spring, and k a quide. As will be apparent from the drawing, the guide k is screwed in the housing a via thread grooves l. Thus, as this guide k is turned, the degree of elastic deformation of the spring j is regulated, so that the working pressure of the pressure switch can be adjusted.

To the pressure receiving section b is connected a pressure unit not shown, hence, a pressurized fluid is introduced from this pressure unit into the path c. When the pressure of the fluid exceeds the force exerted by the spring j, the diaphragm d deflects and the piston rod h moves in the direction of the arrow Ah in opposition to the spring j, so that the switch i is pushed and switched over. Thus, the foregoing assembly functions as the pressure switch.

However, the aforementioned pressure switch has the following drawbacks. That is, since the spring j is always urging the piston g in the direction of the arrow Aj, the spring j suffers fatigues and its resiliency changes as the result of secular change. Hence, the working pressure or setting value of the pressure switch varies. Therefore, adjustment of such a value must frequently be performed during the service.

SUMMARY OF THE INVENTION

The present invention has been devised to solve the aforementioned drawbacks.

Thus, it is an object of the present invention to provide a pressure sensor adapted for use in pressure switches and the like, which exhibits little change in its setting pressure value even used for a long term and needs a smaller number of adjustments than that needed by the conventional pressure switch.

It is another object of the present invention to provide a pressure sensor which can operate in response to, measure and detect a wider range of pressure than that handled by the conventional device.

To achieve the foregoing objects, the present invention provides a pressure sensor which in a preferred form comprises: a force balance valve having a gas chamber sealed at one end by a valve diaphragm and filled with a pressurized gas, a housing having a first cylinder to which the force balance valve is attached; the first cylinder having a first piston held in contact with the valve diaphragm, a second cylinder with a second piston provided in the housing, a pressure receiving section provided in communication with the second piston via a pressure receiving diaphragm, a connecting member with an actuating section for connecting the first and second pistons, and a working section being actuated by the actuating section to take either its first or second state.

The above and other objects and configurations of the present invention will become clear from the following description when taken in conjunction with the accompanying drawings.

DESCRIPTION OF THE PREFERRED EMBODIMENTS

Embodiments of the present invention will now be described with reference to FIGS. 1 and 2.

Figure 1:
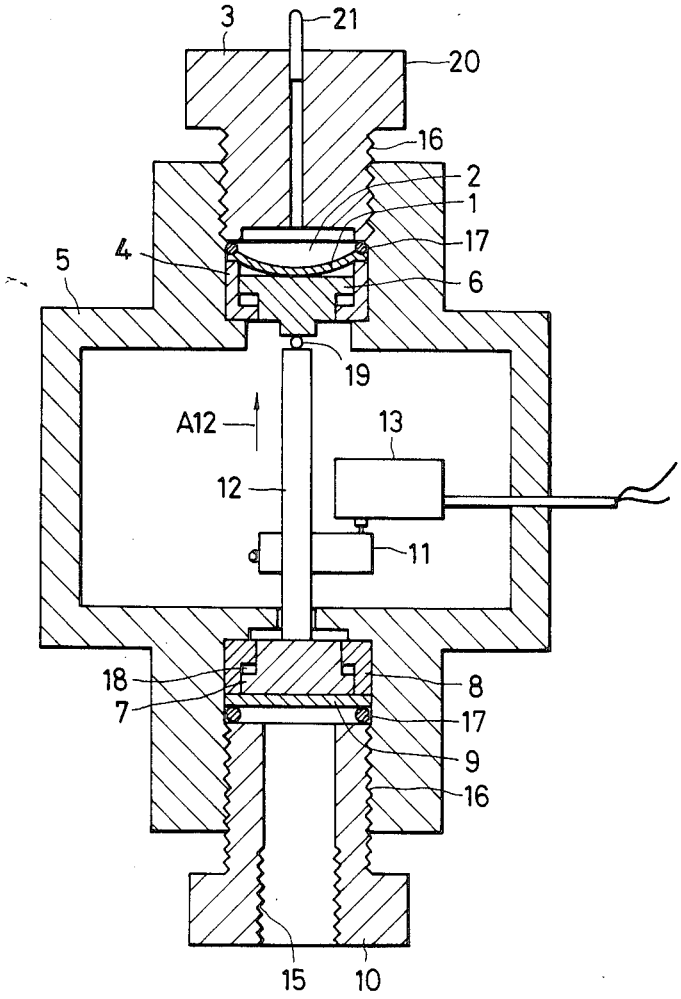
FIG. 1 is a vertical sectional view of an embodiment of a pressure sensor according to the present invention.

In FIG. 1, reference numeral 1 designates a valve diaphragm provided at one end of a gas chamber 2, and this gas chamber 2 is filled with a pressurized gas; these elements constituting a force balance valve 3. This valve 3 is provided at one end of a housing 5. Reference numeral 4 designates a first cylinder which has a first piston 6 held in contact with the valve diaphragm 1. Reference numberal 7 designates a second piston accommodated in a second cylinder 8; this piston 7 being held in contact with a pressure receiving diaphragm 9. This pressure receiving diaphragm 9 is provided at one end of a pressure receiving section 10 which is mounted to the other end of the housing 5. Between the first piston 6 and the second piston 7 is provided a connecting member 12 having an actuating section 11. Reference numeral 13 designates a working section provided in the housing 5, which is adapted to provide a signal externally or generate an output and actuated by the actuating section 11. Reference numeral 15 designates a threaded section for connection with a fluid pipe not shown, 16 another threaded section being screwed in the housing 5, 17 an O-ring, and 18 a gap. In the embodiment, a micro switch was used as an example of the working section 13. Thus, the foregoing pressure sensor forms a sort of pressure switch.

Further, in FIG. 1, reference numeral 19 designates a ball element, 20 a casing of the force balance valve 3, and 21 a gas sealing pipe.

In practice, there are prepared a plurality of sets of first cylinders 4 and first pistons 6 and of second cylinders 8 and second pistons 7 of different internal diameters, which sets are individually exchangeable with one another.

Accordingly, when the pressure of the fluid brought to the pressure receiving section 10 is to be changed, another second cylinder 8 corresponding to a new fluid pressure is incorporated. Specifically, another second cylinder 8 thus selected has a sectional area which makes a certain ratio between it and the sectional area of the first cylinder 4; that ratio corresponding to the fluid pressure concerned.

In lieu of changing the sectional area of the second cylinder 8, the sectional area of the first cylinder 4 may be changed. Further, the pressure inside the gas chamber 2 of the force balance valve 3 may be changed.

Figure 2:
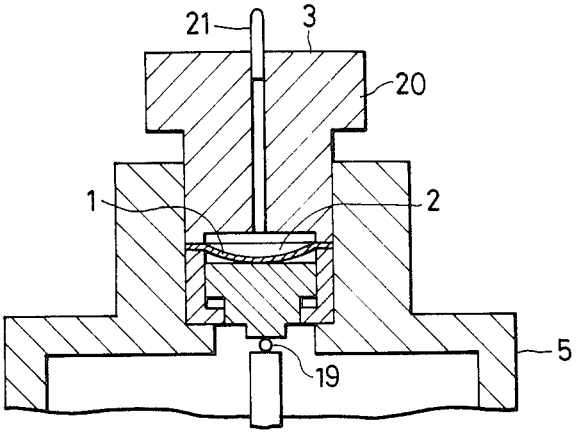
FIG. 2 is a fragmentary sectional view of another embodiment of the pressure sensor according to the present invention.
Figure 3:
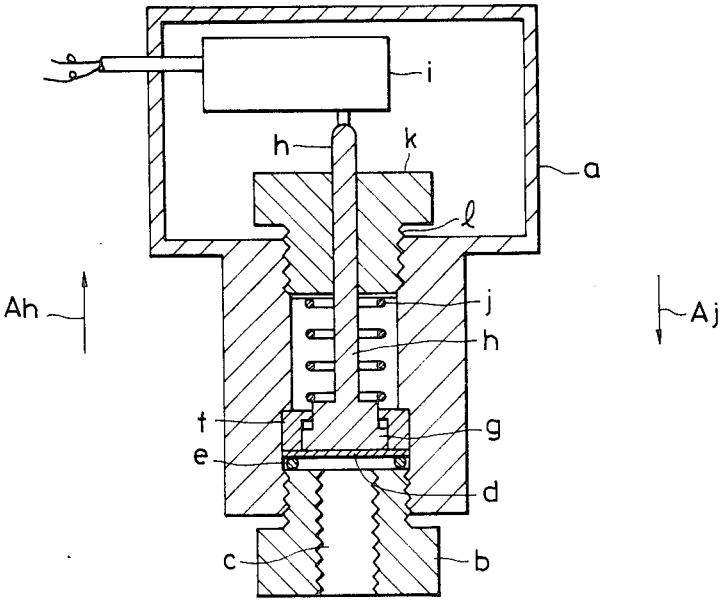
FIG. 3 PRIOR ART
FIG. 3 is a section view of one conventional pressure switch.

Although the force balance valve 3 shown in FIG. 1 includes the valve diaphragm 1 made of a rubber board, this may be made as shown in FIG. 2 in which a thin plate made, for example, of metal is secured to the valve 1 by welding or brazing, or indirectly via a packing (not shown). The configuration of FIG. 2 uses a thin plate of stainless steel. In practice, there are prepared a plurality of mutually exchangeable valves differing in the inside pressure of the gas chamber 2. Reference numeral 19 designates a ball coupling.

The operation of the foregoing pressure sensor will now be described.

Operating fluid for the pressure sensor is supplied to the pressure receiving section 10. In case the pressure of the fluid is not reaching a level sufficient to actuate the pressure sensor, it is maintained in the condition shown in FIG. 1. That is, the pressure of the fluid within the pressure receiving section 10 is not sufficiently strong to deform the valve diaphragm 1 in its contraction direction via the connecting member 12 which valve diaphragm is expanded by the gas within the gas chamber 2. Hence, the connecting member 12 does not move and the working section 13 cannot be actuated.

Following the above, as the pressure of the fluid within the pressure receiving section 10 is increased and the force received by the second piston 7 exceeds the force imposed on the first piston 6 by the pressure of the gas within the gas chamber 2, the connecting member 12 moves in the direction of the arrow A12, hence, the first piston 6 moves also in the same direction via the connecting member 12, and thus the valve diaphragm 1 is pushed and deformed in its contraction direction. In the foregoing course of operation, the actuating section 11 provided on the connecting member 12 works to actuate the working section 13, so that a signal of the form of a current or the like is provided externally from the working section 13.

On the contrary, as the force applied to the second piston 7 is removed, the first piston 6 is moved in the direction opposite to the arrow A12 by the pressure inside the gas chamber 2, hence, the pushing pressure and other relationships are removed from between the actuating section 11 and the working section 13, the externally provided signal, current, or the like is terminated, and the sensor returns to the condition shown in FIG. 1.

In FIG. 2, the casing 20 of the force balance valve 3 is made of metal, such as iron, copper, brass, and aluminum. The embodiment was made of stainless steel. Alternatively, the casing 20 may be made of synthetic resin, ceramics, etc. Reference numeral 21 designates a sealing pipe which is secured to the casing 20 by brazing, welding, etc. and used when filling the gas chamber 2 with gas. After the gas is charged the distal end of the sealing pipe is made airtight. The sealing gas may appropriately be selected from among compressible gases, such as air, nitrogen, oxygen, freon, and hydrogen.

Each of the diaphgrams 1 and 9 will be made of a metallic thin plate as described above; but, it may be made of a film or the like of rubber, plastic, etc. In the case of a film of rubber, plastic, etc., its surface may be coated with a metallic thin layer.

Further, the working section 13 may be a unit or element, such as a switch, which can convert the movement of the actuating section 11 into an electric or other signal to provide the same to the exterior.

Since the present invention is configured as described above, there can be provided the pressure sensor which suffers remarkably reduced fatigues even after a long term use, thus exhibits little change in its setting pressure.

Further, there can be provided the pressure sensor which can operate in response to, measure, and detect a wide range of pressure through exchange of the second cylinders, first cylinders, both cylinders, and/or force balance valves.

What is claimed is:

1. A fluid pressure sensor comprising:

means for sensing a change in pressure of a fluid including a pair of spaced axially aligned chambers, a flexible diaphragm in each chamber dividing it into inner and outer portions and forming a fluid tight seal between said portions; a piston in the inner portion of each of said chambers seated against the adjacent one of said diaphragms and movable axially of said chambers; a rigid, incompressible means of fixed length extending between and engaging both of said pistons whereby axial movement of one piston will be transmitted to the other piston; means sealing a fixed quantity of gas under pressure in the outer portion of one of said chambers port means through which fluid under pressure can be introduced into the outer portion of the other of said chambers; fluid pressure generated forth acting on said diaphragms in said chambers being the only forces acting axially directly or indirectly on said pistons and said rigid means; signal generating means responsive to a shift in the axial position of said rigid means due to the occurrence of a change in the fluid pressure in the outer portion of said other chamber.

2. The fluid pressure sensor claimed in claim 1 wherein the pressure of the gas sealed in the outer portion of said one chamber is equal to the normally maintained pressure of the gas introduced through said port means.

3. The fluid pressure sensor claimed in claim 1 wherein the surface areas of the diaphragms exposed to the fluids in the outer portions of said chambers are different and are selected to compensate for differences in fluid pressure existing in each of said chambers to provide a balance of forces acting on the opposite ends of said rigid means during normal operations.

4. The fluid pressure sensor claimed in claim 1 wherein the diaphragm mounted in said one chamber is convex toward the piston in said chamber with the center portion thereof contacting said piston.

5. The fluid pressure sensor claimed in claim 4 wherein the diaphragm mounted in the other of said chambers is normally flat.

6. The fluid pressure sensor claimed in claim 1 wherein a sleeve is seated in the inner portion of said other chamber, said sleeve being seated against a stop at the inner end of said chamber, said sleeve having an internal bore extending therethrough to slidably receive the piston in said chamber, said sleeve seating against the inner face of said diaphragm reducing the area subject to flexure due to fluid pressure to compensate for fluid introduced at higher pressures through said port while maintaining in balance the forces acting on the opposite ends of said rigid means.

7. The fluid pressure sensor claimed in claim 1 wherein a sleeve is seated in the outer portions of both of said chambers, each of said sleeves being seated against a stop at the inner end of said chambers, each of said sleeves having an internal bore extending therethrough to slidably receive the piston in the chamber, each sleeve seating against the inner face of the diaphragm in the chamber for reducing the area subject to flexure due to fluid pressure to adjust said sensing means for a change in working pressure of the fluid introduced through said port while maintaining in balance the forces acting on the opposite ends of said rigid means.

* * * * *